United States Patent [19]

Tapia

[11] Patent Number: 4,662,828

[45] Date of Patent: May 5, 1987

[54] FUEL INJECTION PUMP BY MEANS OF INDIRECT CONTROL WITH ELASTIC ACCESSORY

[76] Inventor: P. Héctor L. Tapia, M. Arredondo No 2539-Los Cipreses, Lima 1, Peru

[21] Appl. No.: 780,635

[22] Filed: Sep. 26, 1985

Related U.S. Application Data

[63] Continuation-in-part of Ser. No. 570,509, Jan. 13, 1984, abandoned.

[51] Int. Cl.[4] ..... F02M 59/14

[52] U.S. Cl. ..... 417/388

[58] Field of Search ..... 417/383, 386, 387, 388

[56] References Cited

U.S. PATENT DOCUMENTS

| | | | |
|---|---|---|---|
| 2,301,407 | 11/1942 | Houser et al. | 417/387 |
| 2,343,962 | 3/1944 | Dodson | 417/387 |
| 2,395,330 | 2/1946 | Houser | 417/383 |
| 2,458,377 | 1/1949 | Hennings | 417/387 |
| 2,843,045 | 7/1958 | Mashinter | 417/386 |
| 3,000,320 | 9/1961 | Ring | 417/383 |
| 3,494,294 | 2/1970 | Hetz | 417/388 X |

*Primary Examiner*—Leonard E. Smith

[57] ABSTRACT

Modification of the existing system of fuel injection pump, of a kind which moves little pistons catching controllable fuel amount, and compress such fuel until it is forced out through an injector. In the pump used at the present, the mentioned pistons force the fuel to move without returning; in the proposed modification these same pistons move a different fluid, with better lubricating features than fuel, in both directions. The alternative displacement of this different fluid produces pressure variations which are indirectly transmited to fuel through an elastic element (14*a*) that separates the fuel from the other fluid within a hermetically sealed space. Due to the pressure variations induced on the fuel in that way, the fuel is forced to flow toward the injector, by using in its run, suitable inlet (17) and (18) valves. The before mentioned is shown in the figures 2, 2A, 3 and FIG. 2A and 3A.

2 Claims, 4 Drawing Figures

FUEL INJECTION PUMP BY MEANS OF INDIRECT CONTROL WITH ELASTIC ACCESSORY

This application is a continuation in part of application Ser. No. 570,509, filed Jan. 13, 1984, now abandoned.

This invention consists of an improvement on some systems used at the present time for direct fuel injection in internal combustion engines.

By means of the modification that I propose these same pumps will have superior efficiency, longer durability, less maintenance cost and the capability to use other fuels not usable in present injection pumps.

Figure 1:
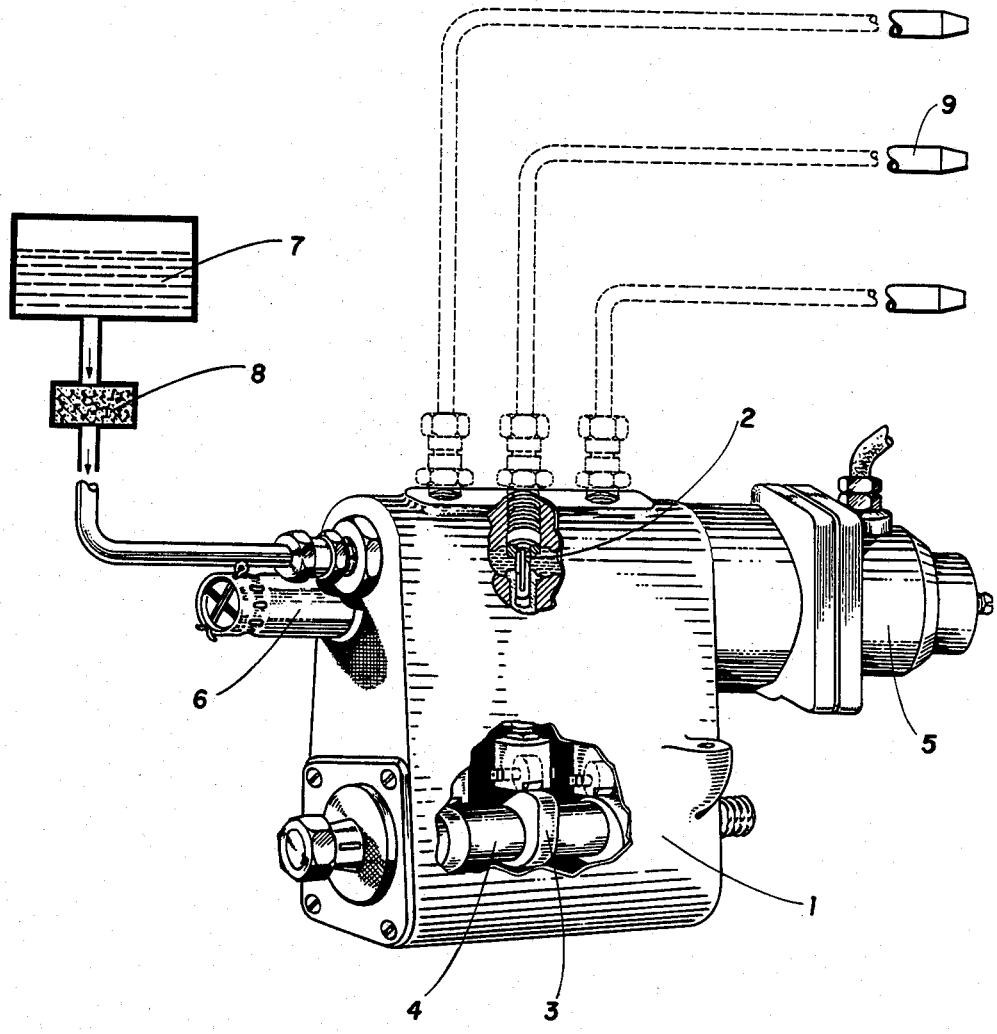

This improvement is explained in these four figures:

FIG. 1 shows an example of the present conventional system. This system consists of one hypothetic injection pump seen in perspective with the removal of a portion of the casing showing the interior mechanism. This figure also includes symbolically basic accessory elements placed before and behind the pump.

Figures 2A, 4:
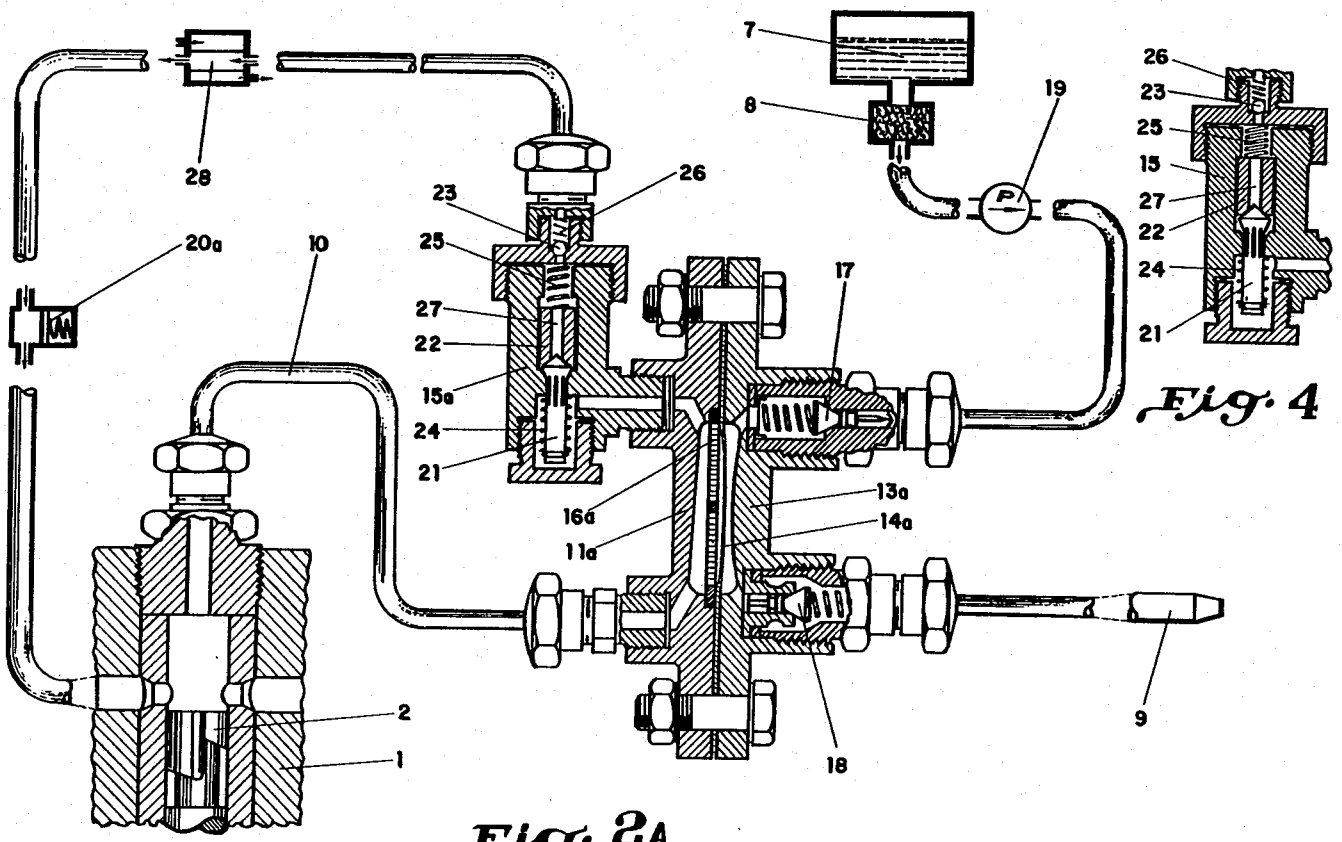

FIG. 2A and FIG. 4 show improvement or modification that I propose for one piston of the pump, showing, by a cross section the existing pump discharge part and also by a partial cross section the auxiliary mechanism described below. This last cross section is passed through the plane of symmetry of that auxiliary mechanism.

Figure 3A:
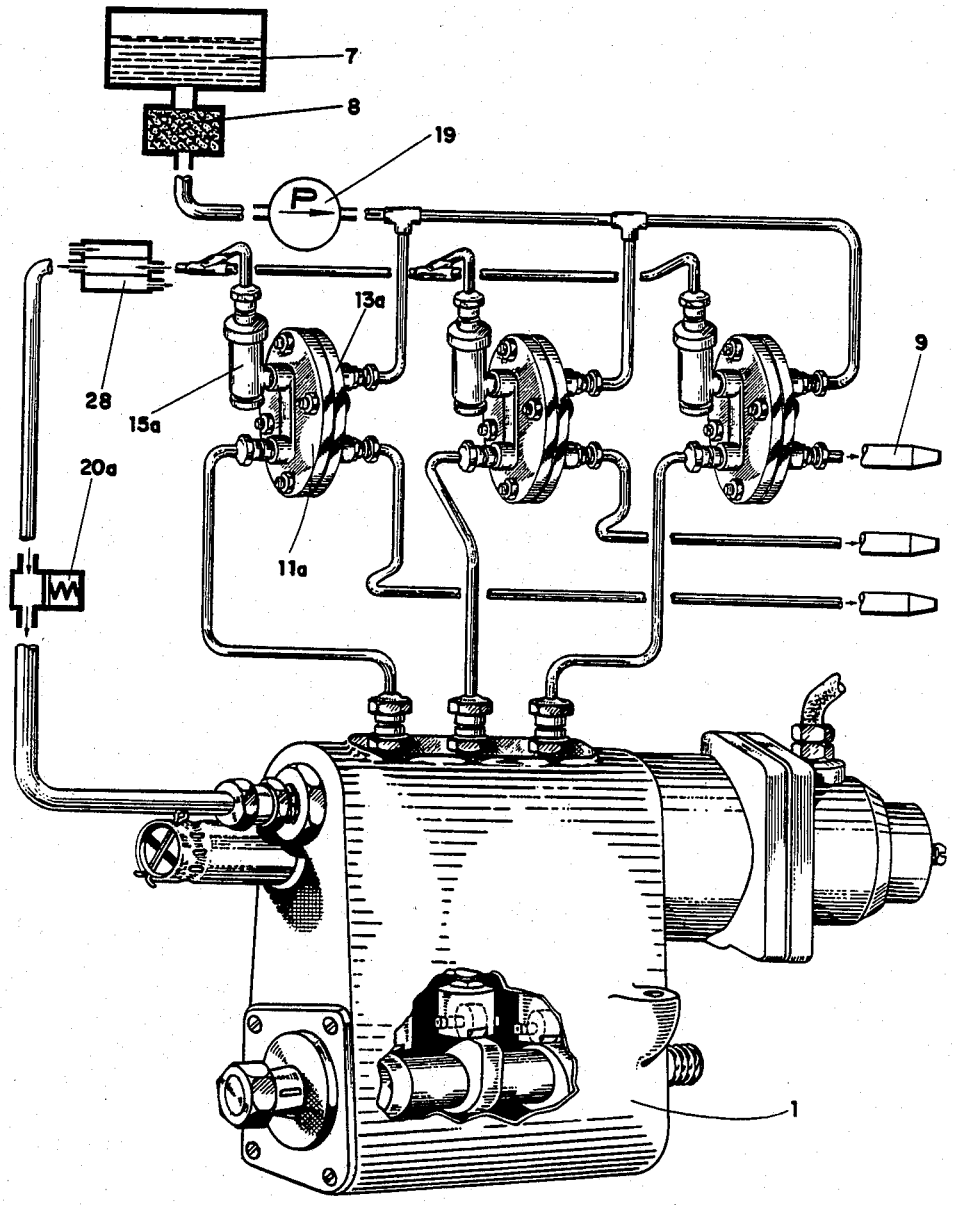

FIG. 3A shows the improvement that I propose for the present system. This figure shows the present pump in perspective and with the auxiliary mechanisms also in perspective. Lastly this figure shows symbolically the basic accessory elements placed before and behind the pump.

The system used at the present in industry that served as the basis for developing this invention consists of a pump of a kind which moves little pistons of adjustable stroke by means of eccentrics or cams, or consists of pistons of constant stroke but revolving and with helicoidal rabbet. These pistons operate in both cases by confining a controllable fuel amount and, by taking into account the engine requirements, compress that fuel amount so that it is forced through an injector into an air mass.

An example of the system used at the present is shown in FIG. 1, wherein has been chosen a hypothetic pump 1 of three pistons 2 which are operated in this case by cams 3 joined to the axle 4. The mentioned pump of revolving pistons is showed with its standard auxiliary elements 5 and 6 for adecuate control of piston revolutions. The modification part that I propose has been removed and only it is showed as reference with dotted lines. This system has been complemented with fuel chamber 7 and filter 8 on the suction site of pump, and injectors 9 on the side of the pump's discharge. These complements are shown in graphical symbols.

The invention is shown in FIGS. 2A and 3A and it consists in the use of this same injection pump by utilizing its variable volumetric displacement mechanism except that instead of working with fuel, this mechanism will utilize other fluid that will not reach the injectors. To continue with the explanation, I will call this other liquid as "liquid A".

By the alternating motion of each piston, Pump 1 controls by "liquid A" through elastic accessory similar to bellows or a membrane, the fuel amount fed by pipe to each injector.

To accomplish this purpose, there must be used and elastic hood or accommodative membrane of impervious material enclosed within a hermetically sealed space, in such a way as to divide the mentioned space into two smaller spaces. "Liquid A" must fill one of these spaces, without gas bubbles. Likewise, the other smaller space must be filled with fuel.

Therefore, volumetric variations that the injection pump produces on the "liquid A" are transmitted by effect of the bellows or membrane defacing the fuel, without mixing the two liquids.

"Liquid A" will not become consumed. It will be suitable for this use with regard to its viscosity, lubricating features and absence of contamination. Consequently, the pump pistons will suffer less attrition and for that reason will last longer without maintenance. On the other hand, the fuel used can be very much lighter and without lubricating quality. For example, gasoline can be used as fuel, also liquid gas can be used whenever it is maintained at correct pressure.

The modification of the present system has its beginning in the outlet of conventional pumps, on the site of consecutive retaining valves with each piston. In my invention these valves are eliminated in order that the "liquid A" flow in both directions with the pistons.

The "liquid A" displacement produced by each piston is led through its respective 10 pipe line toward a hermetically sealed space (that I will call a bellows chamber or membrane chamber) which must be made up of two parts respectively 11*a* and 13*a*. The membrane 14*a* must be fastened between 11*a* and 13*a* by means of bolts and gasket.

The 11*a* body has a constant purge appliance 15*a* and supports a disk 16*a* with multiple small holes.

The number of holes and the diameter of each hole in disk 16*a* basically depends on the consistency, resiliency and other features of membrane 14*a*.

The membrane chamber is completed by the 13*a* piece, which carries two retaining valves in opposite positions. These valves are admission valve 17 and discharge valve 18. Valve 17 is required to yield to the pressure of pump 19. On the other hand, valve 18 responds only to a high pressure performance. Valve 18 works like the retaining valves placed on the discharge of each piston in the existing injection pumps.

The purpose of disk 16*a* is to get a fixed position for membrane 14*a* at the start of each cycle, in spite of the suction vacuum caused by pump 1 or the incoming pressure of the fuel through valve 17, driven by auxiliary pump 19.

Discharge valve 18 will open by the effect of the great pressure increase that the injection pump will produce through the membrane, permitting fuel to flow toward the injector 9.

The success of this system comes from the steadiness of the characteristics of "liquid A". Besides being a lubricant, "liquid A" does not produce gas bubbles.

If lubricating oil for motor cars is used as "liquid A", it is necessary that such oil does not heat. To avoid its heating, its continuous rotating becomes necessary through appliance 15*a*. The functioning of appliance 15*a* is described below.

FIG. 2A shows how the oil, as soon as piston 2 is displaced, reaches the membrane chamber and from there flows to appliance 15*a*. Valve 21 that is located inside appliance 15*a* has two seatings, and some peripheral grooves in the same direction as its shaft. Valve 21 presses the plunger shaped body 22 on its upper seat, driving it toward the top formed by the change of section of its respective cylinder, such as FIG. 4 shows. In this way the quantity of oil from displacement of part 22 is forced to pass through the valve 23. On continuing the displacement of piston 2 the oil can not then pass to applicance 15*a* and consequently displacement of membrane 14*a* is produced, as has previously been described.

When piston 2 is returning, the pressure is reduced and spring 24 forces valve 21 to return to its former position while spring 25 forces piece 22, which has a hole 27 along its shaft, to return to its original position. This comes about from the circulation through the mentioned hole of the oil that has been standing below. This is caused by the vacuum that is produced in the space where spring 25 is, because the spring 26 that is pressing valve 23 prevents the oil from returning. This has the effect that the inside assembly of appliance 15*a* comes back to its original position.

In the foregoing case in which "liquid A" is oil, the pump 1 has to force through each of its pistons 2 and in each cycle an oil volume which is larger than the necessary volume of the displaced fuel. This volume difference will pass through appliance 15*a*.

A mechanical accumulator 20*a* and an eventual cooling appliance 28 complete my sistem so as to maintain always a correct pressure and temperature on the "liquid A" entrance into pump 1.

Different from most conventional diaphragm pumps in which the diaphragm movement is counteracted by the action of a spring to make the diaphragm return to its initial position, the hydraulic action is used in the present mechanism.

FIG. 3A shows how the injection system that I am proposing totally varies the conventional system showed in FIG. 1, for a hypothetic case of an injection pump with three injectors.

What is claimed is:

1. Modification of the existing system of fuel injection pumps for internal combustion engines, in such a manner that the pump instead of directly impelling the fuel toward the injector by means of each piston, impels an auxiliary liquid, which will flow in both directions and nearly in accordance with each piston displacement, these flow variations will produce simultaneous pulsations of an elastic membrane locked within a casing containing a space divided by this membrane, one of these two spaces formed by this division becomes totally filled with auxiliary liquid and the other space totally filled with fuel, at the side of the auxiliary fluid space the membrane leans back at the start of each cycle against a rigid piece, such piece has multiple small holes, through which it is not possible that the elastic membrane penetrates, but the auxiliary fluid to give elasticity to such membrane will pass, this space has an auxiliary fluid draining appliance in constant volume for each displacement cycle of the respective piston of the pump, said piston does not reach to block out an admission hole of the draining appliance allowing a continuous change of the auxiliary fluid and avoiding this fluid to remain without renewal next to the membrane, said pump must be provided with pistons whose displacement volume is the same as the amount of the fuel equivalent volume needed to be injected plus the draining volume.

2. Modification of the existing system of fuel injection pumps for internal combustion engines, in such a manner that the pump instead of directly impelling the fuel toward the injector by means of each piston, impels an auxiliary liquid, which will flow in both directions and nearly in accordance with each piston displacement, these flow variations will produce simultaneous pulsations of an elastic membrane locked within a casing containing a space divided by this membrane, one of these two spaces formed by this division becomes totally filled with auxiliary liquid and the other space totally filled with fuel, at the side of the auxiliary fluid space the membrane leans back at the start of each cycle against a rigid piece, such piece has multiple small holes, through which it is not possible that the elastic membrane penetrates, but the auxiliary fluid to give elasticity to such membrane will pass, this space has an auxiliary fluid draining appliance in constant volume for each displacement cycle of the respective piston of the pump, said pump must be provided with pistons whose displacement volume is the same as the amount of the fuel equivalent volume needed to be injected plus the draining volume, such draining appliance has two valves, one after the other, the first valve in the fluid direction closes against a sliding cylinder, the second valve prevents flow in the opposite direction.

* * * * *